US009437936B2

(12) United States Patent
Lee et al.

(10) Patent No.: US 9,437,936 B2
(45) Date of Patent: Sep. 6, 2016

(54) METAL CASING FOR MOBILE COMMUNICATION DEVICE

(71) Applicant: QUANTA COMPUTER INC., Tao Yuan Hsien (TW)

(72) Inventors: Chi-Hsuan Lee, Tao Yuan Hsien (TW); Chien-Chun Cheng, Tao Yuan Hsien (TW); Yi-Chun Chen, Tao Yuan Hsien (TW); Pei-Ling Teng, Tao Yuan Hsien (TW); Kuo-Cheng Chen, Tao Yuan Hsien (TW)

(73) Assignee: QUANTA COMPUTER INC., Tao Yuan Hsien (TW)

( * ) Notice: Subject to any disclaimer, the term of this patent is extended or adjusted under 35 U.S.C. 154(b) by 0 days.

(21) Appl. No.: 14/570,395

(22) Filed: Dec. 15, 2014

(65) Prior Publication Data

US 2015/0303969 A1 Oct. 22, 2015

(30) Foreign Application Priority Data

Apr. 16, 2014 (TW) ..... 103113905 A

(51) Int. Cl.

| | |
|---|---|
| ***H01Q 21/30*** | (2006.01) |
| ***H01Q 1/24*** | (2006.01) |
| ***H01Q 21/28*** | (2006.01) |
| *H01Q 1/48* | (2006.01) |

(52) U.S. Cl.

CPC ..... *H01Q 21/30* (2013.01); *H01Q 1/243* (2013.01); *H01Q 1/244* (2013.01); *H01Q 21/28* (2013.01); *H01Q 1/48* (2013.01)

(58) Field of Classification Search

None

See application file for complete search history.

(56) References Cited

U.S. PATENT DOCUMENTS

| | | | | |
|---|---|---|---|---|
| 2008/0278381 | A1* | 11/2008 | Lai | H01Q 1/2291 343/700 MS |
| 2012/0098709 | A1* | 4/2012 | Chun | H01Q 1/243 343/702 |
| 2013/0181871 | A1* | 7/2013 | Eom | H01Q 1/243 343/702 |
| 2014/0118215 | A1* | 5/2014 | Hsu | H01Q 1/48 343/853 |

* cited by examiner

*Primary Examiner* — Leon-Viet Nguyen

(74) *Attorney, Agent, or Firm* — Nixon & Vanderhye P.C.

(57) ABSTRACT

A mobile communication device includes a case member, a circuit module and a radiating arm. The case member includes first and second case portions, each made of a metallic material. One of the first and second case portions has a feed-in portion configured to be fed with a radio frequency signal. One of the first and second case portions has a ground portion. The circuit module includes a radio frequency circuit and a ground conductor. The radio frequency circuit is coupled with the feed-in portion and is con figured to generate the radio frequency signal. The ground conductor is coupled to the ground portion and the first case portion. The radiating arm is coupled to the second case portion.

18 Claims, 6 Drawing Sheets

METAL CASING FOR MOBILE COMMUNICATION DEVICE

CROSS-REFERENCE TO RELATED APPLICATION

This application claims priority of Taiwanese Application No. 103113905, filed on Apr. 16, 2014.

FIELD OF THE INVENTION

The present invention relates to a mobile communication device, more particularly to a mobile communication device with a metal case member.

BACKGROUND OF THE INVENTION

With the rapid development of communication technology, mobile communication devices (such as smart phones) are becoming more popular. In order to attract customers, a metal case is often adopted in a mobile communication device as an attention grabber. However, the metal case of the mobile communication device may impede wireless signal transmission.

SUMMARY OF THE INVENTION

Therefore, an object of the present invention is to provide a mobile communication device with a metal case member and with good performance in terms of signal transmission.

Accordingly, a mobile communication device of the present invention includes a case member, a circuit module and a radiating arm.

The case member includes a first case portion and a second case portion that is disposed adjacent to the first case portion. Each of the first case portion and the second case portion is made of a metallic material. One of the first case portion and the second case portion has a feed-in portion that is configured to be fed with a radio frequency signal. One of the first case portion and the second case portion has a ground portion.

The circuit module includes a substrate, a radio frequency circuit and a ground conductor. The radio frequency circuit is disposed on the substrate, is coupled with the feed-in portion, and is configured to generate the radio frequency signal. The ground conductor is disposed on the substrate and is coupled to the ground portion and the first case portion.

The radiating arm is coupled to the second case portion.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENTS

Figure 1:
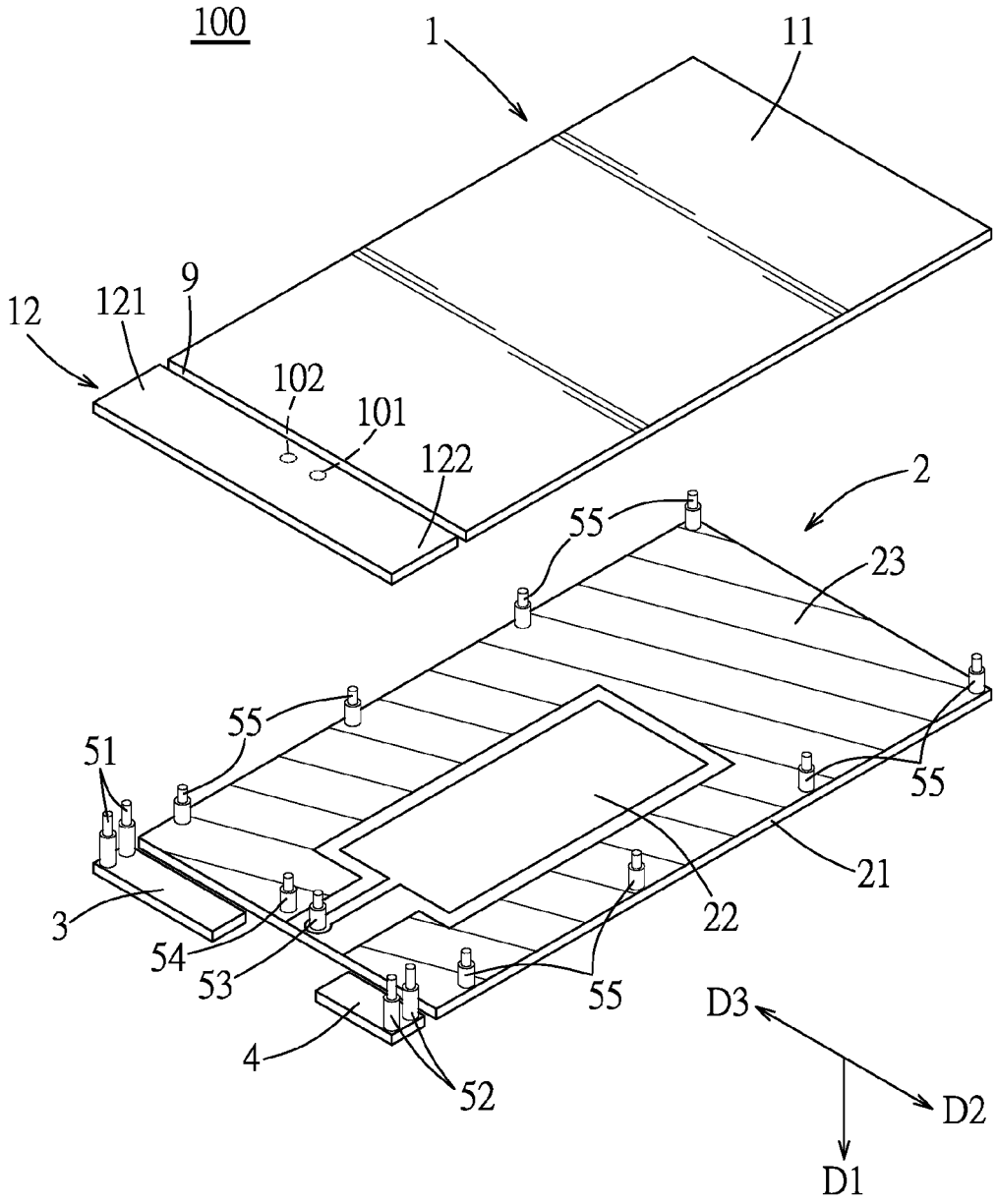
FIG. 1 is an exploded perspective view of a first embodiment of a mobile communication device according to the present invention.

Before the present invention is described in greater detail, it should be noted that like elements are denoted by the same reference numerals throughout the disclosure.

Figure 2:
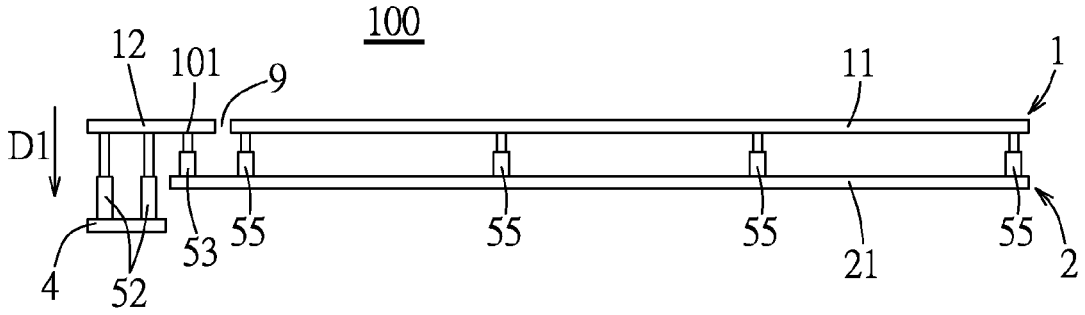
FIG. 2 is a schematic side view of the first embodiment.

Referring to FIGS. 1 and 2, a first embodiment of a mobile communication device 100 of the present invention is shown to include a case member 1, a circuit module 2, a first radiating arm 3, a second radiating arm 4, two first conductive members 51, two second conductive members 52, a third conductive member 53, a fourth conductive member 54 and a plurality of fifth conductive members 55.

The case member 1 in this embodiment is a rear case part of the mobile communication device 100, and includes a first case portion 11 and a second case portion 12 that is disposed adjacent to the first case portion 11. The case member 1 is formed with a slot 9 that separates the first case portion 11 and the second case portion 12 from each other. The first case portion 11 is a rectangular plate having an area bigger than that of the second case portion 12. The second case portion 12 is an elongated strip having a first end part 121 and a second end part 122 that is opposite to the first end part 121. Each of the first case portion 11 and the second case portion 12 is made of a metallic material (e.g., aluminum). One of the first case portion 11 and the second case portion 12 has a feed-in portion 101 that is configured to be fed with a radio frequency signal. One of the first case portion 11 and the second case portion 12 has a ground portion 102. In this embodiment, the second case portion 12 has the feed-in portion 101 and the ground portion 102.

The circuit module 2 includes a substrate 21, a radio frequency circuit 22 disposed on the substrate 21, and a ground conductor 23 disposed on the substrate 21. The radio frequency circuit 22 is coupled with the feed-in portion 101, is configured to generate the radio frequency signal, and is configured to feed the radio frequency signal to the feed-in portion 101. The ground conductor 23 is coupled to the ground portion 102 and the first case portion 11. A detailed description of a coupling method of the radio frequency circuit 22 to the feed-in portion 101 and a detailed description of a coupling method of the ground conductor 23 to the ground portion 102 and the first case portion 11 are provided in the succeeding paragraphs.

The first radiating arm 3 and the second case portion 12 are spaced apart from each other along a first direction (D1). The second radiating arm 4 and the second case portion 12 are spaced apart from each other along the first direction (D1). The first conductive members 51 interconnect the first radiating arm 3 and the first end part 121 of the second case portion 12 such that the first radiating arm 3 is coupled to the first end part 121 of the second case portion 12. The second conductive members 52 interconnect the second radiating arm 4 and the second end part 122 of the second case portion 12 such that the second radiating arm 4 is coupled to the second end part 122 of the second case portion 12.

In this embodiment, the first radiating arm 3 extends from the first conductive members 51 along a second direction (D2) that is transverse to the first direction (D1). The second radiating arm 4 extends from the second conductive members 52 toward the first radiating arm 3 along a third direction (D3) that is opposite to the second direction (D2). Each of the first conductive members 51 is a pogo pin in this embodiment, and has a fixed end that is disposed at the first radiating arm 3 and a free end that abuts against the first end part 121 of the second case portion 12. Similarly, each of the second conductive members 52 is a pogo pin in this embodiment, and has a fixed end that is disposed at the second radiating arm. 4 and a free end that abuts against the second end part 122 of the second case portion 12.

The third conductive member 53 interconnects the radio frequency circuit 22 and the feed-in portion 101 such that the radio frequency circuit 22 is coupled with the feed-in portion 101. The third conductive member 53 is a pogo pin in this embodiment, and has a fixed end that is disposed at the radio frequency circuit 22 on the substrate 21 and a free end that abuts against the feed-in portion 101 of the second case portion 12. The fourth conductive member 54 interconnects the ground conductor 23 and the ground portion 102 such that the ground conductor 23 is coupled to the ground portion 102. The fourth conductive member 54 is a pogo pin in this embodiment, and has a fixed end that is disposed at the ground conductor 23 on the substrate 21 and a free end that abuts against the ground portion 102 of the second case portion 12.

The fifth conductive members 55 interconnect the first case portion 11 and the ground conductor 23 such that the first case portion 11 is coupled to the ground portion 23. Each of the fifth conductive members 55 is a pogo pin in this embodiment, and has a fixed end that is disposed at the ground conductor 23 on the substrate 21 and a free end that abuts against the first case portion 11. Instead of a pogo pin, at least one of the first to fifth conductive members 51~55 may have a different configuration, such as a conductive spring or a conductive screw, in other embodiments of this invention.

It is noteworthy that disposal of the feed-in portion 101 and the ground portion 102 on the second case portion 12 according to the first embodiment of the present invention turns the second case portion 12 into a radiator so as to transmit the radio frequency signal. Moreover, a first electrical path from the feed-in portion 101 on the second case portion 12 to the first conductive members 51 and the first radiating arm 3 results in a first resonant frequency band. A second path from the feed-in portion 101 on the second case portion 12 to the second conductive members 52 and the second radiating arm 4 results in a second resonant frequency band that is different from the first resonant frequency band. That is to say, a multi-band transmission of the mobile communication device is thus achieved. By virtue of the abovementioned configuration, lengths of the first and second electrical paths may be adjusted to obtain a desired effectiveness of signal transmission by simply adjusting at least one of: the position of the feed-in portion 101; the position of the ground portion 102; the length and/or shape of the first radiating arm 3; and the length and/or shape of the second radiating arm 4. In other words, there is no need to change the appearances (e.g., the length, the shape, etc.) of the first and second case portions 11, 12 of the case member 1 for adjustment of the effectiveness of signal transmission. Furthermore, by coupling the first case portion 11 to the ground conductor 23, a shielding effect attributed to the first case portion 11 may be improved.

Figure 3:
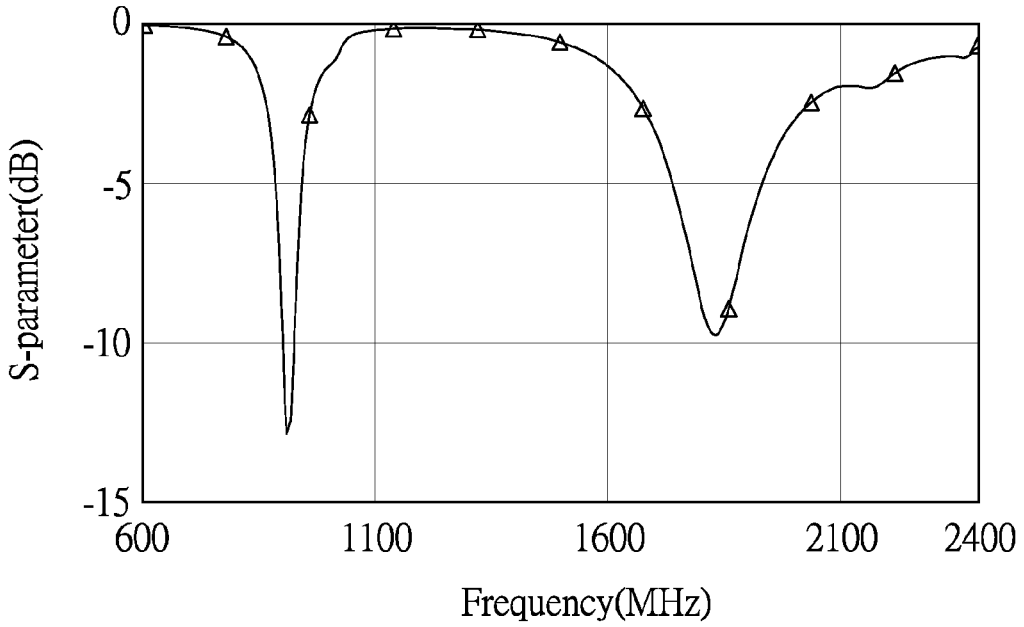
FIG. 3 is a plot showing S-parameters of the first embodiment.

FIG. 3 is a plot showing S-parameters of the first embodiment of the mobile communication device 100 according to the present invention, the plot being related to a return loss of the feed-in portion 101. In particular, FIG. 3 indicates that the return loss under frequencies of 850~950 MHz and 1700~2000 MHz is smaller than −2 dB, proving that the mobile communication device 100 may perform well in multi-band transmission.

Figure 4:
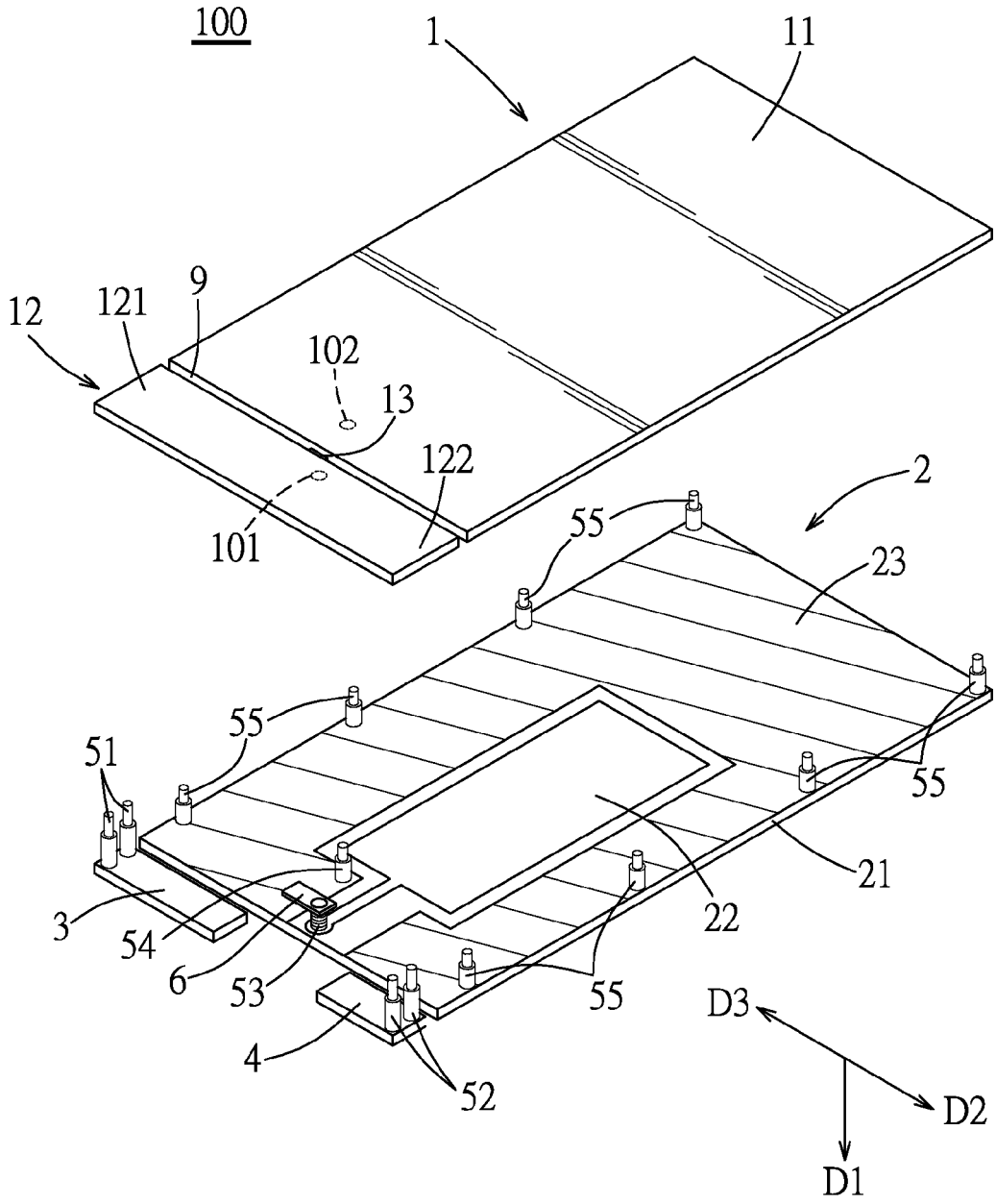
FIG. 4 is an exploded perspective view of a second embodiment of the mobile communication device according to the present invention.
Figure 5:
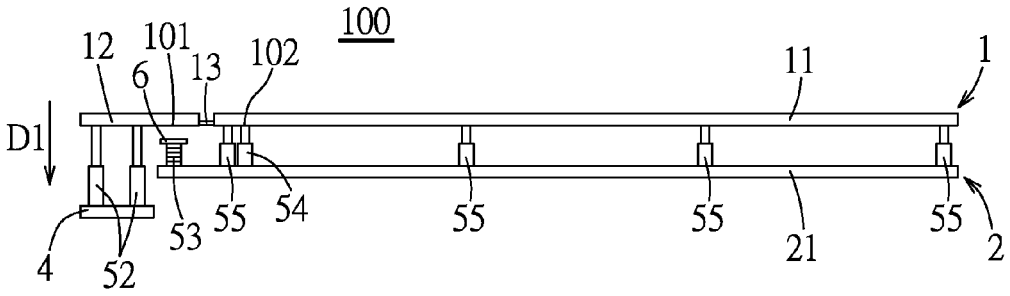
FIG. 5 is a schematic side view of the second embodiment.

Referring to FIGS. 4 and 5, a second embodiment of the mobile communication device 100 of the present invention is shown to be similar to the first embodiment. The differences between the first and second embodiments reside in that: the mobile communication device 100 in the second embodiment further includes a feed-in conductor 6; the third conductive member 53 in the second embodiment is a screw connected between the feed-in conductor 6 and the substrate 21; the first case portion 11 has the ground portion 102 in the second embodiment; and the case member 1 in the second embodiment further includes a connecting portion 13 that is disposed in the slot 9 and that interconnects the first case portion 11 and the second case portion 12.

Specifically, the third conductive member 53 interconnects the radio frequency circuit 22 and the feed-in conductor 6. The feed-in conductor 6 is spaced apart from and disposed adjacent to the feed-in portion 101 such that the radio frequency signal is fed to the feed-in portion 101 by coupling via the feed-in conductor 6 and the third conductive member 53. By virtue of the feed-in conductor 6, a frequency band of signal transmission of the mobile communication device 100 is broadened. It is understood that the first case portion 11, the second case portion 12 and the connecting portion 13 may be made as one-piece such that the first case portion 11 and the second case portion 12 may be aligned precisely upon manufacture.

Figure 6:
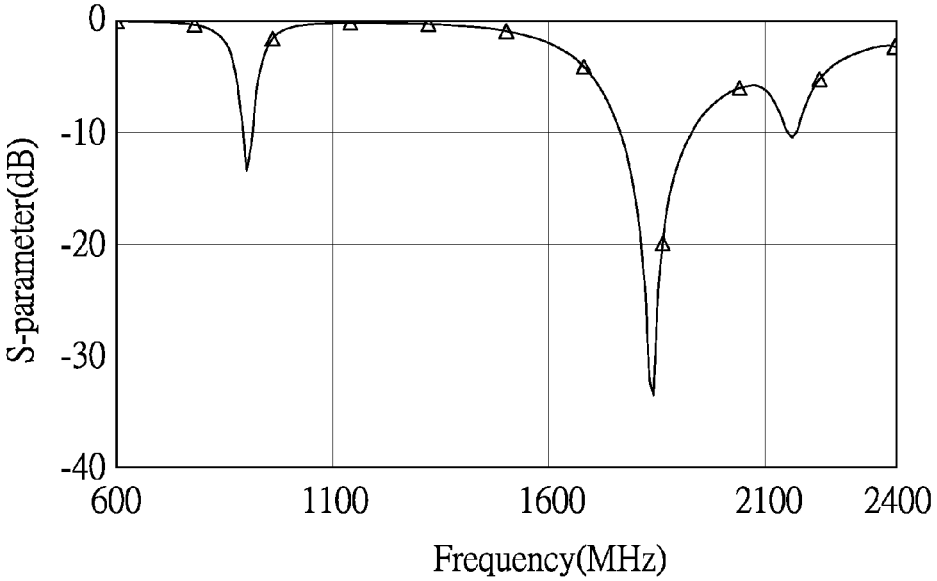
FIG. 6 is a plot showing S-parameters of the second embodiment.

FIG. 6 is a plot showing S-parameters of the second embodiment of the mobile communication device 100 according to the present invention. In particular, FIG. 6 indicates that a return loss under frequencies of 850~950 MHz and 1600~2400 MHz is smaller than −2 dB, proving that the mobile communication device 100 may perform well in multi-band transmission and in broadband transmission.

Figure 7:
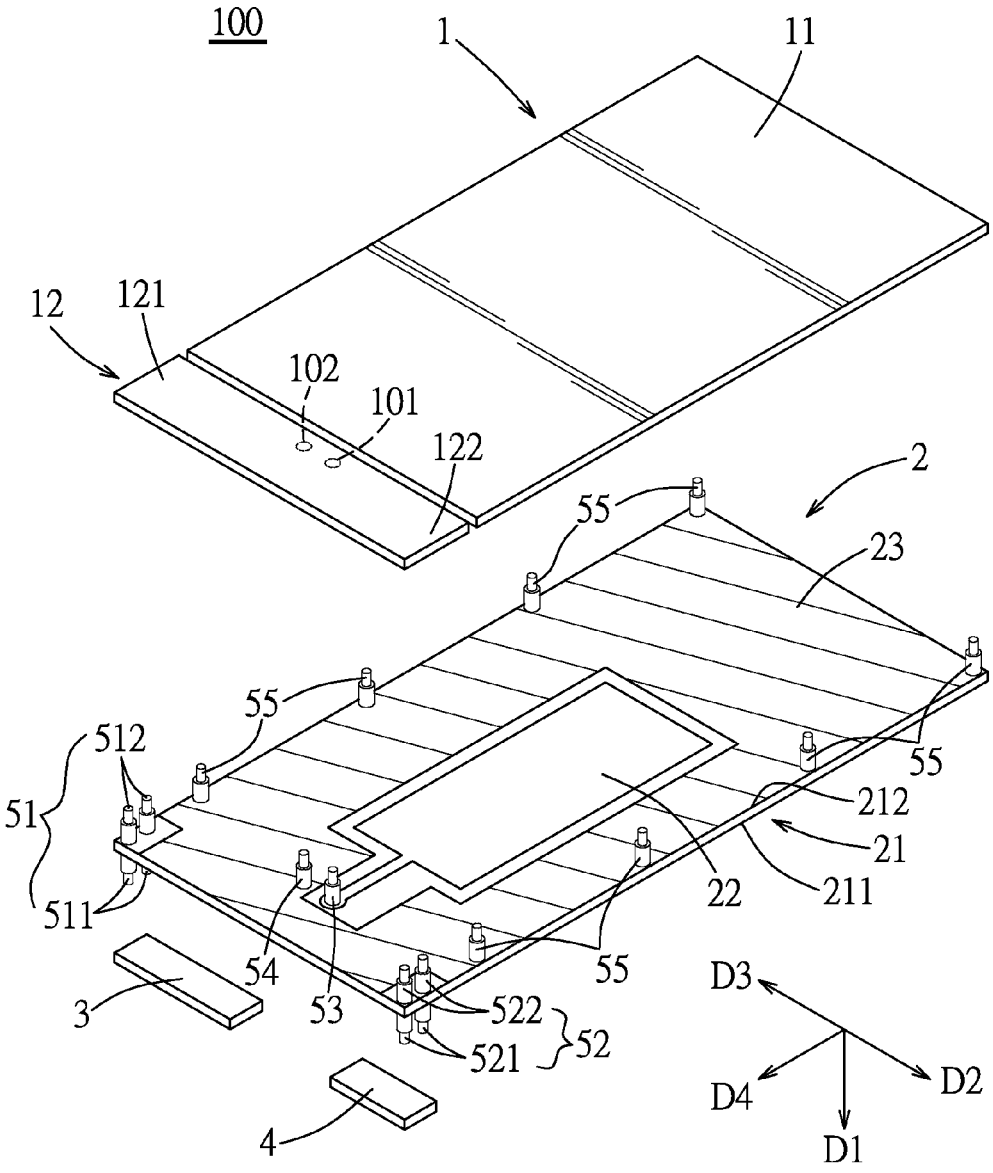
FIG. 7 is an exploded perspective view of a third embodiment of the mobile communication device according to the present invention.
Figure 8:
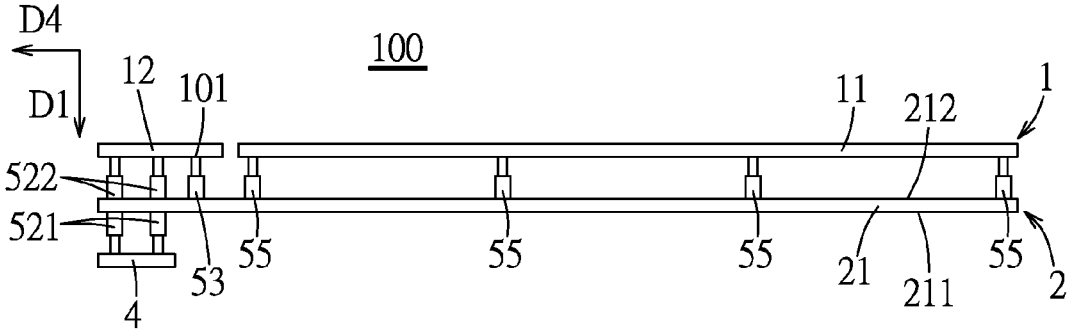
FIG. 8 is a schematic side view of the third embodiment.

Referring to FIGS. 7 and 8, a third embodiment of the mobile communication device 100 of the present invention is similar to the first embodiment. The only difference resides in that each of the first conductive members 51 has a first segment 511 and a second segment 512, and each of the second conductive members 52 has a first segment 521 and a second segment 522. The substrate 21 of the circuit module 2 has a first surface 211 and a second surface 212 that is opposite to the first surface 211 and that faces toward the first and second case portions 11, 12.

The first segments 511 of the first conductive members 51 interconnect the first radiating arm 3 and the first surface 211 of the substrate 21. The second segments 512 of the first conductive members 51 interconnect the second surface 212 of the substrate 21 and the first end part 121 of the second case portion 12. Therefore, the first radiating arm 3 is coupled with the first end part 121 of the second case portion 12 by the first and second segments 511, 512 of the first conductive members 51 and the substrate 21. Each of the first and second segments 511, 512 in this embodiment is a pogo pin in this embodiment.

The first segments 521 of the second conductive members 52 interconnect the second radiating arm 4 and the first surface 211 of the substrate 21. The second segments 522 of the second conductive members 52 interconnect the second surface 212 of the substrate 21 and the second end part 122 of the second case portion 12. Therefore, the second radiating arm 4 is coupled with the second end part 122 of the second case portion 12 by the first and second segments 521, 522 of the second conductive members 52 and the substrate 21. Each of the first and second segments 521, 522 is a pogo pin in this embodiment.

It is understood that each of the segments 511, 512, 521, 522, the third conductive member 53, the fourth conductive member 54 and the fifth conductive members 55 may be selected from the group consisting of a pogo pin, a conductive spring and a conductive screw. The present invention should not be limited in this respect To conclude, by virtue of the feed-in portion 101 and the ground portion 102 on one of the first and second case portions 11, 12, in combination with coupling the first case portion 11 to the ground conductor 23, the first and second case portions 11, 12 may serve as radiators so as to transmit radio frequency signals. Moreover, the configuration of the first and second radiating arms 3, 4 of the present invention simplifies adjustment of the effectiveness of signal transmission, and enables the mobile communication device 100 to achieve multi-band transmission and broadband transmission under the condition that the appearance of the mobile communication device 100 is unchanged.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A mobile communication device, comprising:

a case member including a first case portion and a second case portion that is disposed adjacent to said first case portion, each of said first case portion and said second case portion being made of a metallic material, one of said first case portion and said second case portion having a feed-in portion that is configured to be fed with a radio frequency signal, one of said first case portion and said second case portion having a ground portion, wherein said radio frequency signal is fed directly to one of said first case portion and said second case portion;

a circuit module having an inner surface that abuts a first surface of the first case portion and a corresponding first surface of the second case portion, including a substrate, a radio frequency circuit that is disposed on said substrate, that is coupled with said feed-in portion, and that is configured to generate the radio frequency signal, and a ground conductor that is disposed on said substrate and that is coupled to said ground portion and said first case portion; and a first radiating arm coupled to said second case portion.

2. The mobile communication device as claimed in claim 1, wherein said second case portion and said first radiating arm are spaced apart from each other along a first direction.

3. The mobile communication device as claimed in claim 2, further comprising a second radiating arm that is coupled to said second case portion and that is spaced apart from said second case portion along the first direction.

4. The mobile communication device as claimed in claim 3, wherein said second case portion is an elongated strip having a first end part and a second end part that is opposite to said first end part, said first radiating arm and said second radiating arm being coupled to said first end part of said second case portion and said second end part of said second case portion, respectively.

5. The mobile communication device as claimed in claim 4, further comprising:

a first conductive member interconnecting said first radiating arm and said first end part of said second case portion; and a second conductive member interconnecting said second radiating arm and said second end part of said second case portion.

6. The mobile communication device as claimed in claim 5, wherein:

said first radiating arm extends from said first conductive member along a second direction that is transverse to the first direction; and said second radiating arm extends from said second conductive member toward said first radiating arm along a third direction that is opposite to the second direction.

7. The mobile communication device as claimed in claim 5, further comprising:

a third conductive member interconnecting said radio frequency circuit and said feed-in portion; and a fourth conductive member interconnecting said ground conductor and said ground portion.

8. The mobile communication device as claimed in claim 7, further comprising a plurality of fifth conductive members interconnecting said first case portion and said ground conductor.

9. The mobile communication device as claimed in claim 5, further comprising:

a feed-in conductor that is spaced apart from and disposed adjacent to said feed-in portion;

a third conductive member interconnecting said radio frequency circuit and said feed-in conductor such that the radio frequency signal is fed to said feed-in portion by coupling via said feed-in conductor and said third conductive member; and a fourth conductive member interconnecting said ground conductor and said ground portion.

10. The mobile communication device as claimed in claim 9, further comprising a plurality of fifth conductive members interconnecting said first case portion and said ground conductor.

11. The mobile communication device as claimed in claim 5, wherein:

said first conductive member has a first segment that interconnects said first radiating arm and said substrate of said circuit module, and a second segment that interconnects said substrate and said first end part of said second case portion; and said second conductive member has a first segment that interconnects said second radiating arm and said substrate of said circuit module, and a second segment that interconnects said substrate and said second end part of said second case portion.

12. The mobile communication device as claimed in claim 11, further comprising:

a third conductive member interconnecting said radio frequency circuit and said feed-in portion; and a fourth conductive member interconnecting said ground conductor and said ground portion.

13. The mobile communication device as claimed in claim 12, further comprising a plurality of fifth conductive members interconnecting said first case portion and said ground conductor.

14. The mobile communication device as claimed in claim 11, wherein said first segment and said second segment of said first conductive member are disposed at opposite surfaces of said substrate, respectively, and said first segment and said second segment of said second conductive member are disposed at the opposite surfaces of said substrate, respectively.

15. The mobile communication device as claimed in claim 1, wherein said case member is formed with a slot that separates said first case portion and said second case portion from each other.

16. The mobile communication device as claimed in claim 15, wherein said case member further includes a connecting portion that is disposed in said slot and that interconnects said first case portion and said second case portion.

17. The mobile communication device as claimed in claim 1, wherein said case member is a rear case part of the mobile communication device.

18. The mobile communication device as claimed in claim 5, wherein each of said first conductive member and said second conductive member is selected from the group consisting of a pogo pin, a conductive spring and a conductive screw.

* * * * *